US008267016B2

(12) United States Patent
Akoshita et al.

(10) Patent No.: US 8,267,016 B2
(45) Date of Patent: Sep. 18, 2012

(54) OPEN/CLOSE CONTROL SYSTEM FOR INSPECTION LID

(75) Inventors: Haruo Akoshita, Nagoya (JP); Mitsuaki Murota, Nagoya (JP); Minoru Nakao, Nagoya (JP); Mamoru Tanaka, Tokyo (JP); Kouji Yokoyama, Yokohama (JP); Kazuhiro Yoshizawa, Yamato (JP)

(73) Assignees: Nippon Sharyo, Ltd., Aichi (JP); Central Japan Railway Company, Aichi (JP)

( * ) Notice: Subject to any disclaimer, the term of this patent is extended or adjusted under 35 U.S.C. 154(b) by 360 days.

(21) Appl. No.: 12/597,987

(22) PCT Filed: Jun. 18, 2008

(86) PCT No.: PCT/JP2008/061092

§ 371 (c)(1),
(2), (4) Date: Oct. 28, 2009

(87) PCT Pub. No.: WO2009/001721

PCT Pub. Date: Dec. 31, 2008

(65) Prior Publication Data

US 2010/0126075 A1 May 27, 2010

(30) Foreign Application Priority Data

Jun. 22, 2007 (JP) ..... 2007-165064

(51) Int. Cl.
*E05F 15/00* (2006.01)

(52) U.S. Cl. ..... 105/349; 105/395; 105/308.1; 105/280; 105/341; 105/348

(58) Field of Classification Search ..... 105/395, 105/308.1, 280, 282.1, 329.1, 332, 339, 341, 105/377.07, 348, 349; 292/92
See application file for complete search history.

(56) References Cited

U.S. PATENT DOCUMENTS 6,550,831 B2 * 4/2003 Rizk ..... 292/336.3

FOREIGN PATENT DOCUMENTS

| | | | |
|---|---|---|---|
| JP | 62-157672 | U | 10/1987 |
| JP | 02-099019 | U | 8/1990 |
| JP | 10-292694 | A | 11/1998 |
| JP | 2002-347616 | A | 12/2002 |
| JP | 2005-193761 | A | 7/2005 |
| JP | 2005-213984 | A | 8/2005 |
| JP | 2006-290193 | A | 10/2006 |

* cited by examiner

*Primary Examiner* — Mark Le
(74) *Attorney, Agent, or Firm* — Sughrue Mion, PLLC

(57) ABSTRACT

An open/close control system for an inspection lid adapted not to open while a vehicle travels. An emergency release device is provided behind the inspection lid, where the emergency release device disables power transmission of a driver which opens and closes a side entrance/exit door of a railway vehicle. The emergency release device is installed in a space inside a wall surface inside the vehicle, and the space can be opened and closed by the inspection lid. The open/close control system has a locking device provided in the space inside the wall surface in order to restrict rotation of the inspection lid, and also has an open/close controller which detects traveling of the railway vehicle to actuate the locking device.

9 Claims, 4 Drawing Sheets

OPEN/CLOSE CONTROL SYSTEM FOR INSPECTION LID

TECHNICAL FIELD

The present invention relates to emergency release means such as an emergency release cock for allowing a side entrance/exit door of a railway vehicle to be manually opened and in particular relates to an open/close control system for an inspection lid (an access cover) for controlling opening/closing of the inspection lid in a wall surface inside which an emergency release means is installed.

BACKGROUND ART

For instance, a railway vehicle is configured such that a side entrance/exit door provided in a side body frame is opened/closed by an air cylinder in which air supplied thereto is pressurized during traveling to keep the entrance/exit door in a closed state. In case of emergence, it is necessary for passengers to open the door to freely go outside. In the railway vehicle, therefore, an emergency release cock is provided to release the air to thereby allow opening/closing of the door. This emergency release cock is installed for example inside a wall surface with an inspection lid in the vicinity of the door.

However, the emergency release cock is easily accessible by every person. Patent Literature 1 listed below therefore proposes an emergency release cock configured not to operate during traveling. Specifically, a locking device for restringing rotation of a handle is provided near the emergency release cock and a box-shaped keyhole is provided in an end of the handle on an operating side, respectively. By excitation of a locking solenoid, a lock pin is inserted in the keyhole to restrict the rotation of the handle.

CITATION LIST

Patent Literature 1: JP 2002-347616 A

SUMMARY OF INVENTION

Technical Problem

Meanwhile, the conventional emergency release cock the operation of which is disabled during traveling as above could achieve an object for suppressing mischief at a certain level. However, a simple structure that restricts rotation of the emergency release cock is considered insufficient for suppressing more malicious mischief. Because it is conceivable that a person who maliciously opens the inspection lid sometimes may easily abandon malicious or mischievous access to the emergency release cock in face thereof, whereas sometimes may break down the locking device. During vehicle traveling, therefore, it is originally considered effective in disabling opening of the inspection lid that closes the space in which the cock is placed. In case of emergency, on the other hand, it is necessary to reliably enable opening of the cock in a safe condition where the vehicle is stopped. Such problem may occur not only in the case where the air cylinder is used as a door engine, but also in the case where an electric actuator is used. In this case, energization to the electric actuator is stopped to allow the side entrance/exit door to be opened and closed. Thus, the same applies to an emergency release switch or the like placed inside the inspection lid.

The present invention has been made to solve the above problems and has a purpose to provide an open/close control system for an inspection lid adapted not to open while a vehicle travels.

Solution to Problem

An open/close control system for inspection lid according to the present invention, there is provided an open/close control system for inspection lid, including emergency release means that disables power transmission of drive means for opening and closing a side entrance/exit door of a railway vehicle, the emergency release means being installed in a space inside a wall surface of the vehicle, the space being opened and closed by the inspection lid, the system comprising: a locking device provided in the space inside the wall surface to restrict rotation of the inspection lid; and an open/close control device for detecting traveling of the railway vehicle and operating the locking device.

In the open/close control system for inspection lid according to the invention, preferably, the locking device includes: a lock plate fixed on the inside of the inspection lid; and a locking solenoid that causes a lock pin to protrude by a solenoid to restrict rotation of the inspection lid through the lock plate.

In the open/close control system for inspection lid according to the invention, preferably, the locking solenoid includes an urging member to retreat the lock pin.

In the open/close control system for inspection lid according to the invention, preferably, the open/close control device is configured to receive a detection signal from a speed sensor and operate the locking device based on a fixed speed.

Furthermore, in the open/close control system for inspection lid according to the invention, preferably, the drive means is an air cylinder or an electrical actuator, and the emergency release means is an emergency release cock for releasing working air from the air cylinder to the atmosphere or an emergency release switch for shutting off energization to the electrical actuator from a power supply coupled thereto.

Advantageous Effects of Invention

According to the open/close control system for inspection lid according to the invention, the inspection lid is locked and disabled from opening during vehicle traveling, but the inspection lid is unlocked and enabled to open during vehicle stop. Therefore, even if a person attempts to touch the emergency release means such as an emergency release cock and an emergency release switch with malicious or mischievous intent during vehicle traveling, the inspection lid disabled from opening makes the person abandon such intent. It is therefore effective in suppressing operation of the emergency release means during traveling. In case of emergency such as fires, the inspection lid is unlocked while the vehicle is stopped so that the emergency release means can be operated for safe escape.

The present invention provides a simple configuration that the lock pin is caused to protrude by the solenoid to interfere with the lock plate to block rotation of the inspection lid. Thus, the above effect can be achieved at low cost. With such simple configuration, the lock pin is unlikely to become snagged on the lock plate when the inspection lid is unlocked, thereby reliably enabling operation of the emergency release cock after unlocking. In particular, the inspection lid may be forcibly unlocked by the urging member to more reliably enable the operation of the emergency release cock.

REFERENCE SIGNS LIST

Figure 1:
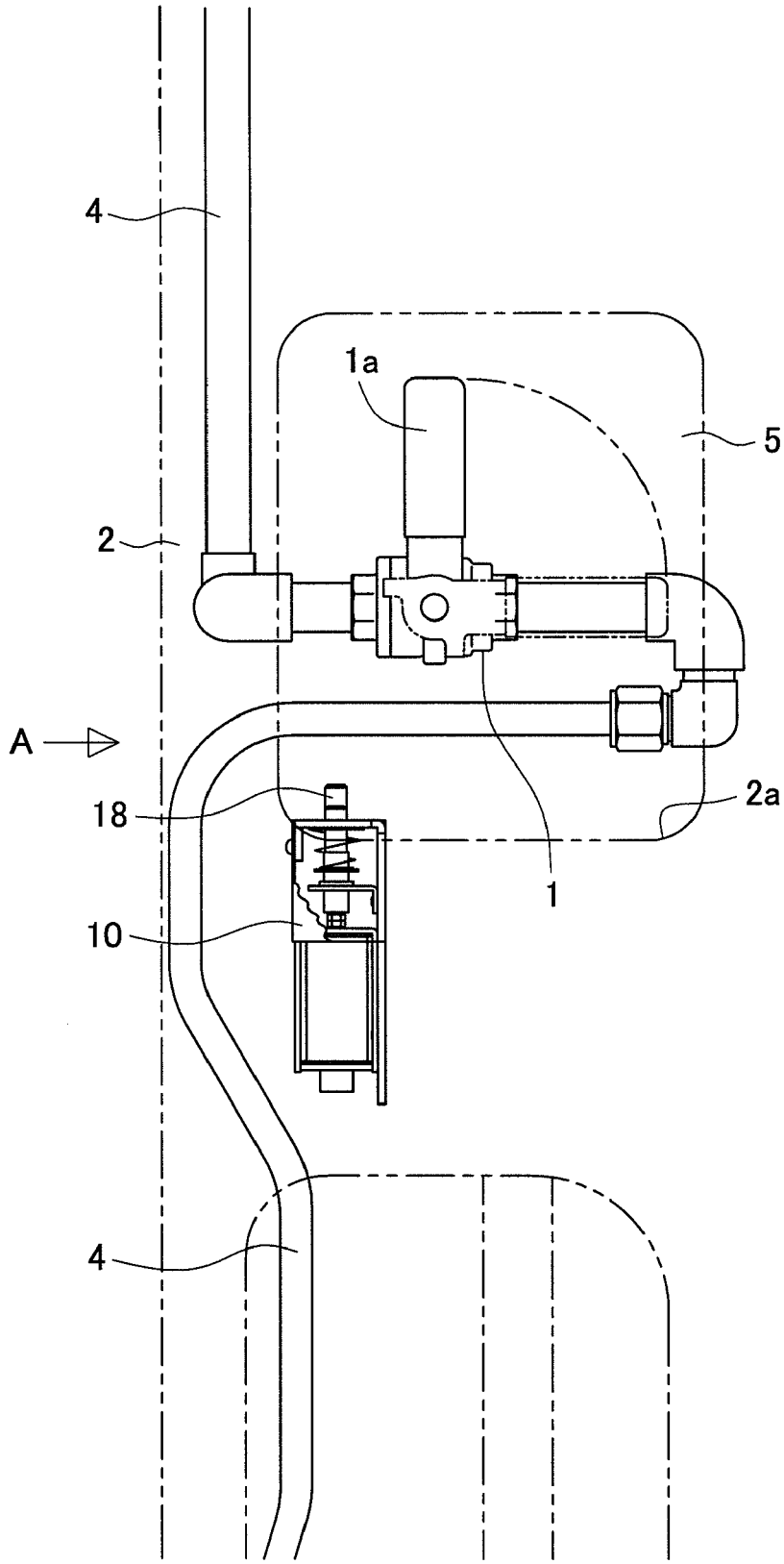
FIG. 1 is a perspective view showing an emergency release cock and a locking device provided in the space inside a wall surface of a railway vehicle.

1 Emergency release cock
2 Wall
5 Inspection lid
7 Lock plate
10 Locking solenoid
11 Solenoid
18 Lock pin
19 Return spring
21 Controller

DESCRIPTION OF EMBODIMENTS

A detailed description of a preferred embodiment of an open/close control system for inspection lid embodying the present invention will now be given referring to the accompanying drawings.

For each side entrance/exit door formed in side body frames of a railway vehicle, for example, an air cylinder is used as a door engine and an electromagnetic valve is controlled by an open/close switch in a driver's cabin or the like to supply and discharge high-pressure working air with respect to the air cylinder of each side entrance/exit door. In association with this extension and contraction of the air cylinders, therefore, the doors are controlled together to open and close. On the other hand, an emergency release cock is provided to release air pressure in the air cylinder to the atmosphere in order to allow the door to be opened manually in case of emergency.

Figure 2:
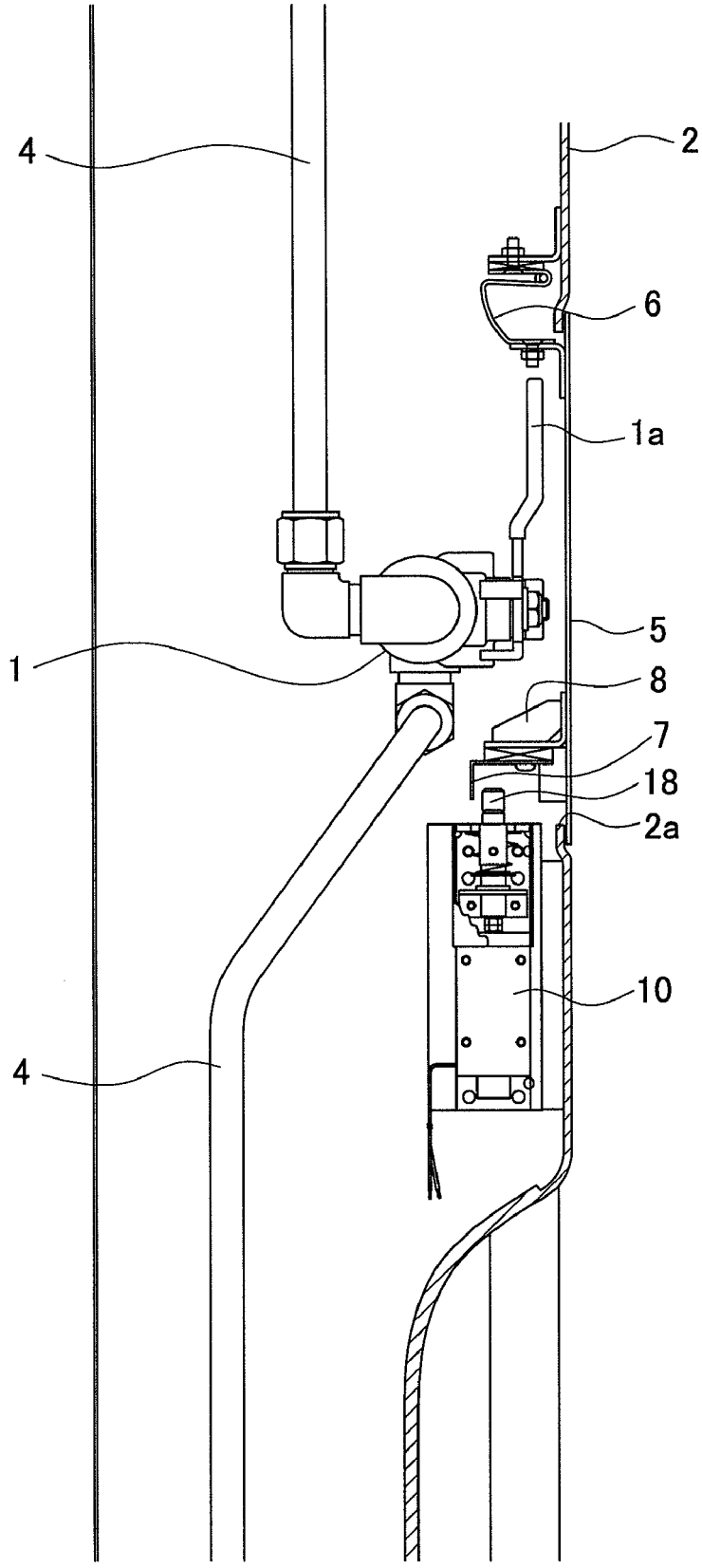
FIG. 2 is a side view of the emergency release cock and the locking device provided in the space inside the wall surface of the railway vehicle seen from a direction indicated by an arrow A in FIG. 1.

Herein, FIG. 1 is a perspective view showing the emergency release cock and a locking device provided in the space inside a wall surface of the railway vehicle. FIG. 2 is a side of the emergency release cock and locking device provided in the space inside the wall surface, seen from a direction indicated by an arrow A in FIG. 1.

An emergency release cock 1 that enables manual opening of the side entrance/exit door is installed in the space inside the wall surface 2 and located in front of an opening 2*a* formed in the wall surface 2. The emergency release cock 1 is connected to an air pipe 4 to release the air pressure supplied to the air cylinder that closes the door to the atmosphere. The cock 1 is provided with a handle 1*a* in face of the opening 2*a*. By 90°-rotation of the handle 1*a*, a valve is switched to open or close.

In the opening 2*a* of the wall surface 2, an inspection lid 5 is provided so as to be normally closed, forming a part of the wall surface 2. Accordingly, the presence of the cock 1 is usually confirmed by a name plate placed near the inspection lid 5 but the cock is out of passengers' sight. In emergency, however, the inspection lid 5 is opened by a passenger and the handle 1*a* is turned to open the valve of the emergency release cock 1. Thus, working air is released from the air cylinder, allowing the door to be manually opened. In this embodiment, for the purpose of enabling the above operation of the emergency release cock 1 only during vehicle stop, the locking device is adapted to disable the inspection lid 5 from opening during vehicle traveling.

The opening 2*a* of the wall surface 2 is defined by an inwardly bent peripheral edge portion as shown in FIG. 2, with which an outer peripheral portion of the inspection lid 5 is placed in contact so that the wall surface 2 and the inspection lid 5 are flush with each other. A hinge member 6 is fixed on the inside of an upper end of the inspection lid 5 and attached to pivotable about a pin. Accordingly, a passenger who stands in front of the wall surface 2 can pick and pull a lower end of the inspection lid 5 to open the opening 2*a*. The locking device is configured to restrict the rotation of the inspection lid 5 held in a closed state.

Figure 3A:
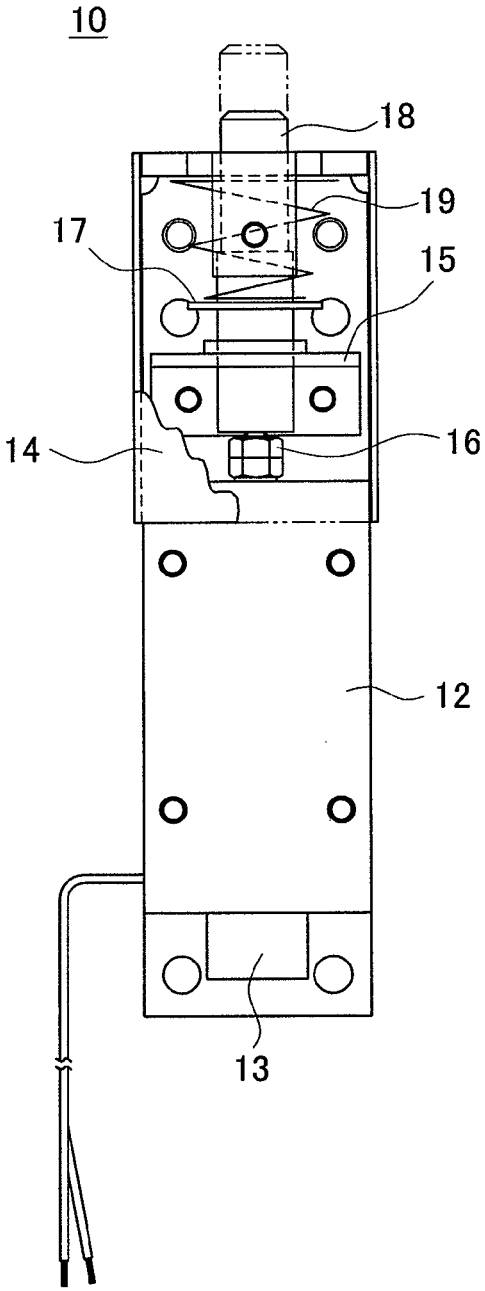
FIG. 3A is an enlarged view of a locking solenoid shown in FIG. 2.
Figure 3B:
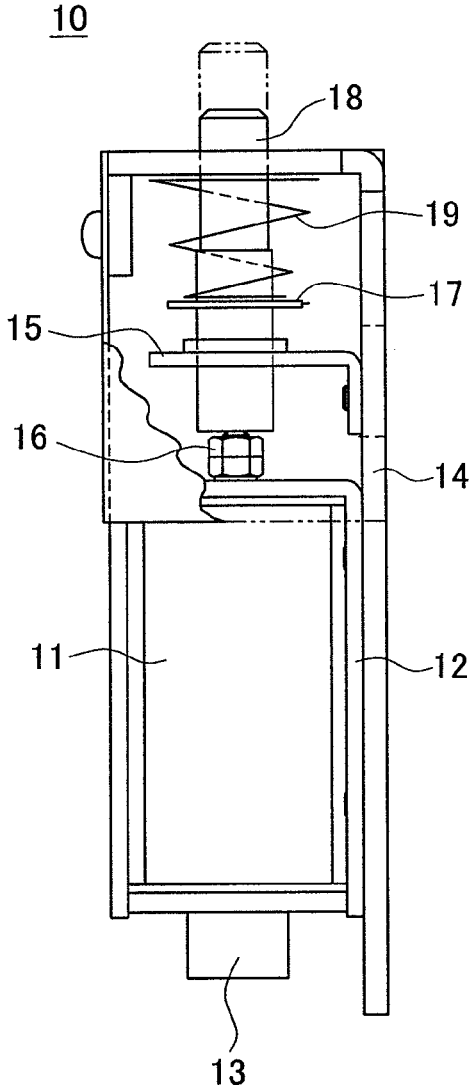
FIG. 3B is an enlarged view of the locking solenoid shown in FIG. 1.

The inspection lid 5 is provided with a lock plate 7 made of metal bent at a right angle and fixed on the inside of a lower end portion of the lid 5. The lock plate 7 is apt to be deformed by forced opening of the inspection lid 5. For easy replacement, therefore, the lock plate 7 is secured with screws to a base 8 fixed to the inspection lid 5. A locking solenoid 10 is provided for this lock plate 7. In the locking solenoid 10, a lock pin 18 is coaxially fixed to a plunger 13 and protrudes upward. Herein, FIG. 3A is an enlarged view of the locking solenoid 10 shown in FIG. 2 and FIG. 3B is another enlarged view of the locking solenoid 10 shown in FIG. 1.

The locking solenoid 10 integrally includes a solenoid 11 which is a wound coil set in a magnetic frame 12. Two terminals are extended from the coil. In the solenoid 11, the plunger 13 is inserted in the coil and moved upward by energization to the solenoid 11. The magnetic frame 12 is fixed to a cover frame 14 to assemble the solenoid 11 with the cover frame 14. The cover frame 14 surrounds an upper part of the solenoid 11. In the cover frame 14, a guide plate 15 is fixed. A lock pin 18 is placed passing through the cover frame 14 and the guide plate 15.

The lock pin 18 is coaxially coupled to the plunger 13 by a coupling nut 16 and fixed with a spring retaining flange 17 above the guide plate 15. One end of the return spring 19 placed around the lock pin 18 abuts the flange 17. The other end of the return spring 19 abuts a ceiling plane of the cover frame 14 to urge the lock pin 18 downward. Thus, the locking solenoid 10 is configured such that when the solenoid 11 is energized, the lock pin 18 is moved up to a position indicated by a chain double-dashed line against the urging force of the return spring 19. During non-energization, on the other hand, even though the plunger 13 is moved downward by its own weight, the plunger 13 is forcibly pressed down by the urging force of the return spring 19 so as to reliably move down even when the lock pin 18 gets snagged on the lock plate 7 or something else.

The above locking solenoid 10 is mounted in the internal space inside the wall surface 2 directly below the opening 2*a* so that the lock pin 18 caused to protrude upward by energization to the solenoid 11 interferes with the lock plate 7. In the open/close control system in this embodiment, opening/closing of the inspection lid 5 is controlled by operation of the locking solenoid 10. In this embodiment, particularly, the inspection lid 5 is locked during vehicle traveling and unlocked during stop.

Figure 4:
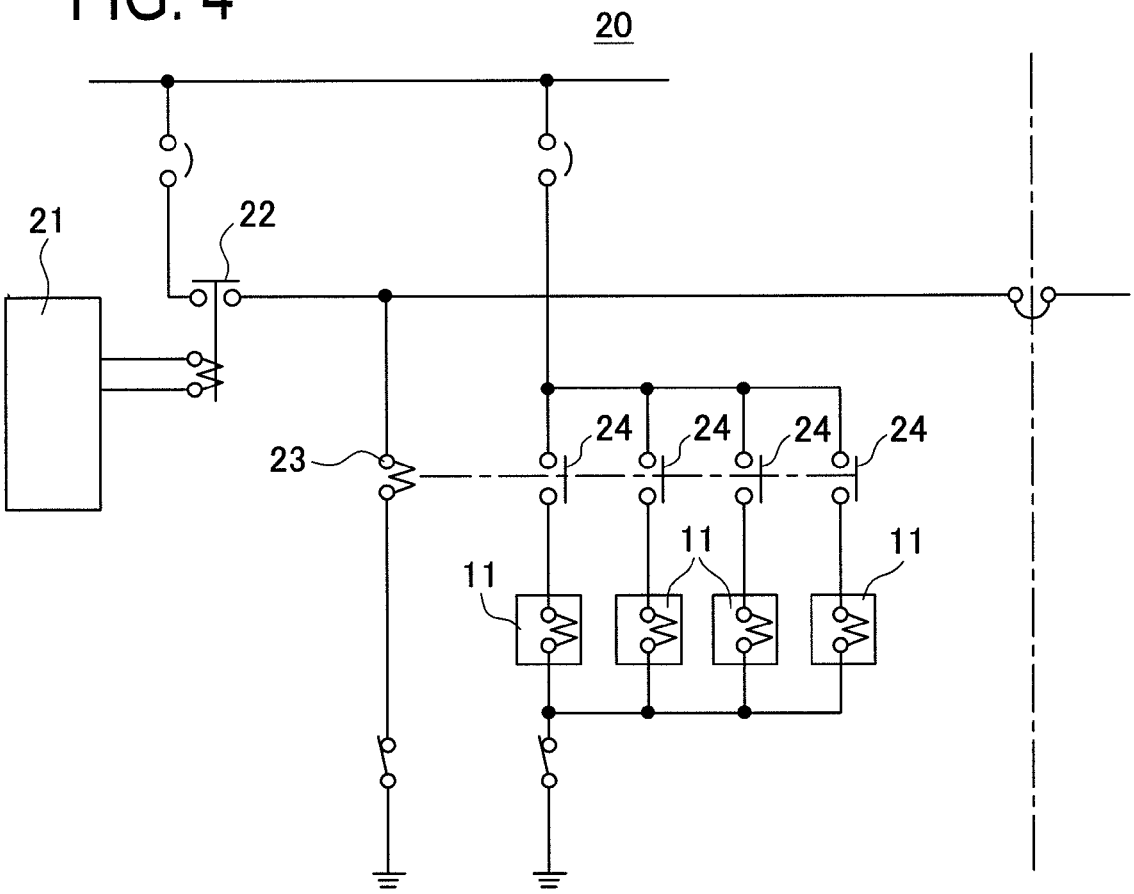
FIG. 4 is a diagram of an electrical circuit for controlling locking operations of the locking solenoid.

FIG. 4 is a diagram showing an electrical circuit for controlling locking operations of the locking solenoids 10. An electrical circuit 20 for controlling the locking solenoids 10 includes a controller 21 to receive a signal from a speed sensor not shown. For instance, this speed sensor is configured to detect a speed of 5 km per hour and generate a speed signal. In this embodiment, therefore, upon receipt of the speed signal representing 5 km per hour, the controller 21 activates a speed relay 22. This speed of 5 km per hour is a value observable just after the start of traveling or just before the stop of traveling. Based on this speed signal, therefore, a traveling state and a stop state of the railway vehicle can be substantially confirmed.

In the railway vehicle, circuit blocks are provided one in each vehicle body, each of the circuit block including a speed signal transfer relay 23 and switches 24 for the solenoids 11 of the locking solenoids 10. The locking solenoids 10 are provided one for each door and hence the switches 24 are provided one for each locking solenoid 10. Accordingly, the switches 24 are switched together ON/OFF by the speed signal transfer relay 23. When the speed relay 22 having an a-contact (a make-contact) is turned ON, the speed signal transfer relays 23 in the whole railway vehicle are energized. In association with this operation, the switches 24 at the contact "a" are also turned ON, thereby energizing the solenoids 11.

The following explanation is given to the operations of the open/close control system for inspection lid in this embodiment. When the railway vehicle starts to travel, the speed signal is transmitted from the speed sensor to the controller 21, which determines that the vehicle has entered a traveling state. As mentioned above, the speed sensor transmits the speed signal at the time when the speed exceeds 5 km per hour. However, it is a very short time before the speed reaches 5 km per hour and hence that signal substantially indicates the start of traveling. Upon the start of traveling of the railway vehicle, accordingly, the controller 21 turns on the speed relay 22 to energize each speed signal transfer relay 23, thereby turning on each switch 24 to energize each solenoid 11 of each locking solenoid 10.

When each solenoid 11 is energized, the plunger 13 in each locking solenoid 10 is moved upward against the urging force of the return spring 19, thus causing the lock pin 18 to protrude upward. An upper end portion of the lock pin 18 moves up to a position corresponding to the lock plate 7. Even if the inspection lid 5 is attempted to be opened for operation of the emergency release cock 1 during traveling, the lock plate 7 is blocked by the lock pin 18, thus not allowing the inspection lid 5 to rotate any more. Consequently, the inspection lid 5 is held in a closed state during traveling, disabling operation of the cock 1. The side entrance/exit door is not allowed to be opened.

When the traveling vehicle is stopped, on the other hand, the speed signal from the speed sensor is transmitted to the controller 21, which determines that the vehicle has been stopped. At that time, the speed relay 22 is turned off by the controller 21 as shown in FIG. 4 to shut off energization to the speed signal transfer relays 23. Accordingly, each switch 24 is also turned off, shutting off energization to each solenoid 11. The plunger 13 is pressed down by the urging force of the return spring 19, moving the lock pin 18 down to a position in which the lock pin 18 does not interfere with the lock plate 7. Thus, the inspection lid 5 is unlocked.

In case of emergency such as fires, in which the side entrance/exit door has to be opened, the inspection lid 5 can be opened in such a manner that the inspection lid 5 is rotated upward about the hinge member 6 on the inside of the upper end. Since the emergency release cock 1 is installed with the handle 1*a* placed closer to the opening 2*a* formed in the wall surface 2, the handle 1*a* is turned to freely open the corresponding door. On the other hand, even in the case other than emergency, the inspection lid 5 can be opened only while the vehicle is stopped. In the open/close control system for inspection lid, therefore, for example a limit switch not shown for detecting opening/closing of the inspection lid 5 is provided to prevent the inspection lid 5 from remaining opened during traveling. This ensures that the inspection lid 5 is held in a closed state during traveling.

According to the open/close control system for inspection lid in this embodiment, the inspection lid 5 is locked and disabled from opening as long as the railway vehicle is running. Even if a person attempts to touch the emergency release cock 1 with malicious or mischievous intent, such action is prevented in advance. It is therefore effective in suppressing operation of the emergency release cock 1 during traveling.

Even in a case with no malicious or mischievous intent, furthermore, in emergency situations such as fires, a passenger conceivably opens the side entrance/exit door during traveling to scramble to escape. Disabling operation of the emergency release cock 1 other than during vehicle stop is thus effective for safe escape.

If the inspection lid 5 is forcibly opened, the lock plate 7 may get snagged on the lock pin 18, not allowing the plunger 13 to be moved down even after energization to the solenoid 11 is shut off. The inspection lid 5 thus remains unlocked. In this embodiment, however, the lock pin 18 is forcibly moved down by the return spring 19. When the railway vehicle is stopped, the emergency release cock 1 is reliably enabled to be operated.

Furthermore, the simple configuration allows the lock pin 18 to protrude upward by the solenoid 11 and interfere with the lock plate 7, thereby disabling the rotation of the inspection lid 5. The aforementioned effects can therefore be achieved at low cost. With such simple configuration, the lock pin 18 is unlikely to get snagged on the lock plate 7, thus ensuring unlocking of the inspection lid 5 to perform the operation of the emergency release cock 1 during vehicle stop. Moreover, the lock pin 18 is forcibly moved down by the return spring 19 to unlock the inspection lid 5 and thus manipulation of the emergency release cock 1 is reliably enabled during vehicle stop.

INDUSTRIAL APPLICABILITY

The open/close control system for inspection lid according to the invention is explained above as one embodiment, but the present invention may be embodied in other specific forms without departing from the essential characteristics thereof.

In the above embodiment, the locking device is constituted of the lock plate 7 and the locking solenoid 10. An alternative may be configured by for instance an air cylinder or the like instead of the locking solenoid 10.

In the above embodiment, the speed sensor is used to detect a vehicle traveling state. The sensor may be any sensor if only it can detect traveling and stop.

In the above embodiment, the railway vehicle using the air cylinder as the door engine is exemplified. The invention may be applied to inspection lids for covering emergency release switches mounted in a railway vehicle configured to open/close side entrance/exit doors by an electrical actuator.

The invention is applied to the inspection lid for covering emergency release means for the side entrance/exit door is placed. Furthermore, the locking device may be provided for another lid in a railway vehicle to restrict opening/closing of the lid so that the locking device is controlled according to traveling of the railway vehicle.

The invention claimed is:

1. An open/close control system for an inspection lid, wherein emergency release means is provided behind the inspection lid, where the emergency release means disables power transmission of drive means for opening and closing a side entrance/exit door of a railway vehicle, the emergency release means being installed in a space inside a wall of the vehicle, the space being opened and closed by the inspection lid, the open/close control system comprising:

a locking device provided in the space inside the wall to restrict rotation of the inspection lid; and an open/close control device which is connected to the locking device, detects traveling of the railway vehicle, operates the locking device in response to a detected traveling to disable opening of the inspection lid while the railway vehicle is traveling, and unlocks the locking device to enable opening of the inspection lid while the vehicle stops.

2. The open/close control system for inspection lid according to claim 1, wherein the locking device includes:

a lock plate fixed on an inside of the inspection lid; and a locking solenoid that causes a lock pin to protrude by a solenoid to restrict rotation of the inspection lid through the lock plate.

3. The open/close control system for inspection lid according to claim 2, wherein the locking solenoid includes an urging member to retreat the lock pin.

4. The open/close control system for inspection lid according to claim 1, wherein the open/close control device is configured to receive a detection signal from a speed sensor and operate the locking device based on a fixed speed.

5. The open/close control system for inspection lid according to claim 1, wherein the drive means is an air cylinder or an electrical actuator, and the emergency release means is an emergency release cock for releasing working air from the air cylinder to the atmosphere or an emergency release switch for shutting off energization to the electrical actuator from a power supply coupled thereto.

6. The open/close control system for inspection lid according to claim 2, wherein the open/close control device is configured to receive a detection signal from a speed sensor and operate the locking device based on a fixed speed.

7. The open/close control system for inspection lid according to claim 3, wherein the open/close control device is configured to receive a detection signal from a speed sensor and operate the locking device based on a fixed speed.

8. The open/close control system for inspection lid according to claim 2, wherein the drive means is an air cylinder or an electrical actuator, and the emergency release means is an emergency release cock for releasing working air from the air cylinder to the atmosphere or an emergency release switch for shutting off energization to the electrical actuator from a power supply coupled thereto.

9. The open/close control system for inspection lid according to claim 3, wherein the drive means is an air cylinder or an electrical actuator, and the emergency release means is an emergency release cock for releasing working air from the air cylinder to the atmosphere or an emergency release switch for shutting off energization to the electrical actuator from a power supply coupled thereto.

* * * * *